United States Patent [19]

Hildebrandt

[11] 3,941,026

[45] Mar. 2, 1976

[54] CLARINET KEY MECHANISM

[76] Inventor: Karl H. Hildebrandt, 521 E. 6th St., Apt. 11, Long Beach, Calif. 90802

[22] Filed: Sept. 16, 1974

[21] Appl. No.: 506,223

[52] U.S. Cl. ..... 84/382
[51] Int. Cl.[2] ..... G10D 7/06
[58] Field of Search ..... 84/380, 382

[56] References Cited

UNITED STATES PATENTS

| | | | |
|---|---|---|---|
| 745,804 | 12/1903 | Ellis | 84/382 |
| 878,333 | 2/1908 | Bonn | 84/382 |
| 1,008,272 | 11/1911 | Julliot | 84/382 |
| 3,238,833 | 3/1966 | Brodzky | 84/382 |

*Primary Examiner*—Lawrence R. Franklin

[57] ABSTRACT

A spring break mechanism is disclosed wherein a key is operatively connected to a key pad cup by means of a needle spring. The motion of the key is transmitted by the spring to the cup. The cup may be moved to open the associated tone hole, even with the key depressed, by means of another key mechanism acting on a lever integral with the cup by overcoming the tension of the spring.

7 Claims, 3 Drawing Figures

CLARINET KEY MECHANISM

BACKGROUND

This invention is directed to a clarinet key mechanism to improve the facility of clarinet fingering.

The Boehm clarinet has been a traditional key system for clarinet usage. It is used on nearly all present-day clarinets in the United States and is the conventional system learned in the United States schools. The Boehm system has several drawbacks in particular keying situations. In that system, B-flat, keyed in the traditional way by means of the A key and the register key, is fuzzy and weak. It has been recognized that this note has needed improvement.

Rosario Mazzeo, in U.S. Pat. No. 2,867,146, defines a structure whereby he intends to improve the throat tone B-flat by employing the right-hand rings and left-hand second finger ring. Mazzeo opens a hole on the side at the correct acoustical position in conjunction with the opened A, A-flat holes to produce a good B-flat tone. In this Mazzeo patent, when slurring from any note involving the rings to the A key, an unwanted intermediate note is sometimes produced. This has been corrected by a later Mazzeo U.S. Pat. No. 3,204,512 with a result that the rings are harder to press. Thus, while the Mazzeo construction does produce a good B-flat tone, it is at the expense of facility of keying.

SUMMARY

In order to aid in the understanding of this invention, it can be stated in essentially summary form that it is directed to a clarinet key mechanism which maintains the G opening open by a mechanism attached to the A-flat key and actuated by depression of the A key to compensate for otherwise inadequate venting while the thumb remains covering the thumb hole to maintain the B-flat opening closed by mechanism from the thumb-ring key to eliminate inadvertent opening of the B-flat hole, as sometimes happens when transitioning from a note involving one or a plurality of the certain B-flat producing rings of a clarinet constructed on a principle whereby the combination of depression of the A key and one or a plurality of the certain rings used to produce a clear throat tone B-flat note to the A note.

Accordingly, it is an object of this invention to provide a clarinet key mechanism which eliminates unwanted grace notes caused by inadvertent opening of the B-flat opening. It is a further object to provide key interrelationships to aid in convenience and accuracy of trilling. It is a further object to provide a C-note by simultaneous operation of the register key and the B key.

Other objects and advantages of this invention will become apparent from a study of the following portion of this specification, the claims, and the attached drawings.

DESCRIPTION

Figure 1:
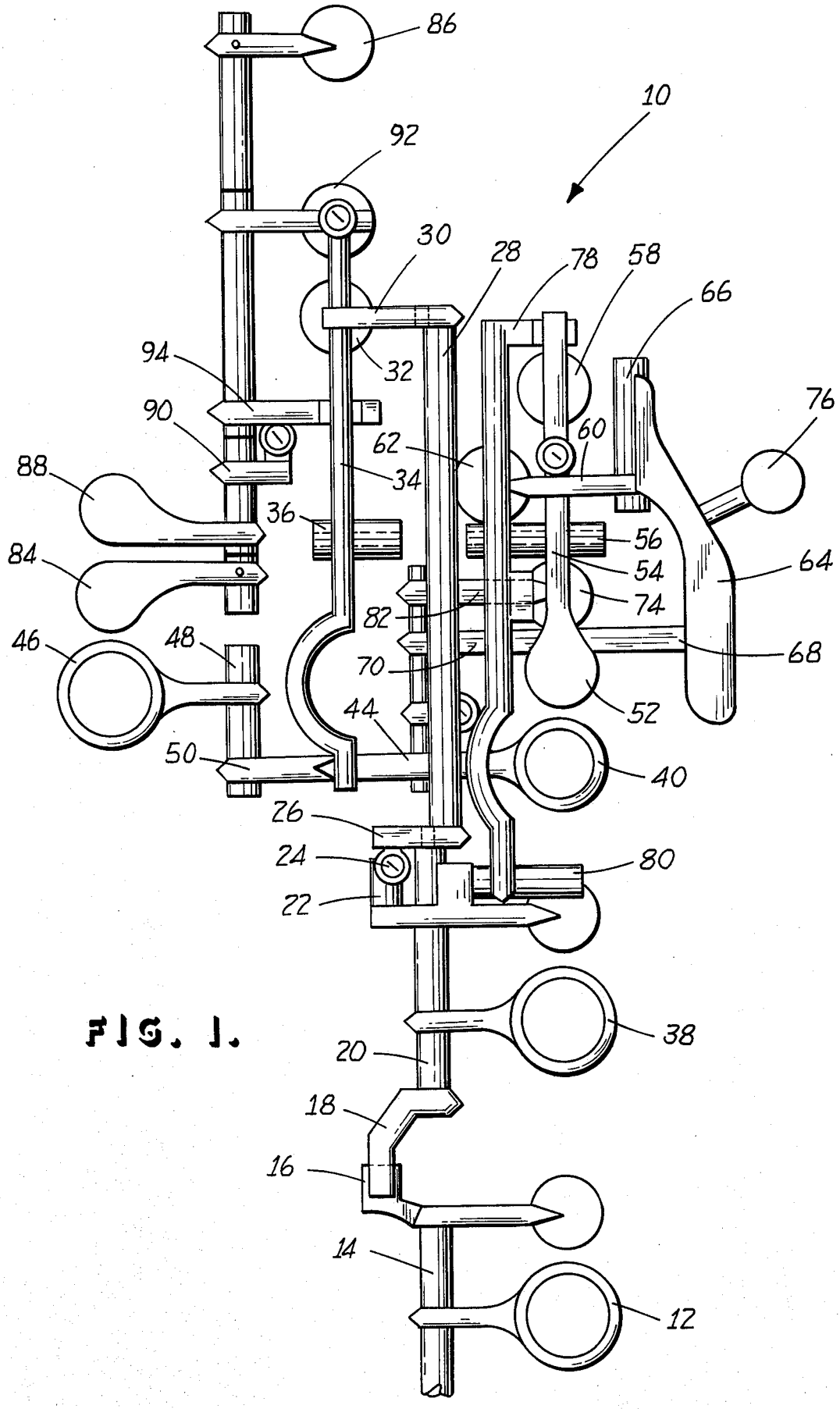
FIG. 1 is a projected view of that portion of a clarinet key mechanism which incorporates the present invention and is associated with other conventional clarinet keys.

The clarinet key mechanism of this invention is generally indicated at 10 in FIG. 1. In FIG. 1, it is shown in a projected unwrapped relationship with respect to the clarinet for convenience in understanding and showing. In reality, it is wrapped around the cylindrical body of the clarinet in a conventional manner. The conventional right-hand rings are shown at 12 and, when depressed, they cause rotation of shaft 14 about its axis to cause raising of lever 16. Lever 16 engages under lever 18 which, in turn, rotates shaft 20 on its axis. Rotation of shaft 20 lifts shoe 22 which is positioned under adjusting screw 24 on lever 26. Thus, counterclockwise rotation of shaft 14, as seen from the upper end of FIG. 1 which is the mouthpiece end of the clarinet, causes counterclockwise rotation of shaft 20 which, in turn, causes counterclockwise rotation of shaft 28 to which lever 26 is fixed. On the uppermost end of shaft 28 is carried lever 30 which engages over key 34.

B-flat pad cup 32 is mounted on B-flat key 34 which is pivoted on a transverse axis through pivot block 36. When the right-hand rings and left-hand number 2 finger ring 38 are released, lever 30 presses down under spring pressure to thrust down on B-flat key 34 and close the B-flat opening by pressing down the B-flat pad cup 32. The B-flat key 34 is lightly spring-loaded to open the B-flat opening so that, when any of the desired rings are pressed, the release of force from lever 30 onto key 34 permits the spring to open the B-flat opening.

Additionally, F-sharp ring or left-hand number 1 finger ring 40 (see FIGS. 1 and 2) is pivoted on the axis of shaft 42. Lever 44 on the outer end of left-hand number 1 finger ring 40 is raised upon depression of the finger ring 40. Lever 44 is positioned under the outer end of B-flat key 34 so that pressing ring 40 rotates B-flat key 34 to close the B-flat opening.

Furthermore, thumbhole ring 46 is mounted to pivot on the axis of shaft 48 and carries lever 50 on the end thereof. Lever 50 engages under the outer end of lever 44, and lever 44 engages under the outer end of B-flat key 34 so that, when the thumbhole ring 46 is depressed, the outer end of B-flat key 34 is raised to close the B-flat opening. Depressing either ring 40 or 46 normally closes the F-sharp key proper 82 which is operatively connected to the left-hand first finger key by spring mechanism 45, shown most clearly in FIGS. 2 and 3.

Now considering the A key, spatula 52 is mounted on the lower end of the A lever 54 which is pivoted on tube 56. When the spatula is depressed, A pad cup 58 opens the A hole. At the same time, for vent purposes to give a clear A tone, A lever 54 engages under A-flat lever 60 to open the A-flat hole under A-flat pad cup 62, as on the conventional clarinet. The A-flat key in turn forces the F-sharp key open by means of levers 68 and 70 connected to spatula 64 and F-sharp key 82, respectively, even though the tumb ring remains depressed, by overcoming the tension of spring 43 in spring break mechanism 45, which spring 43 lies between the F-sharp key 82 and the left hand first finger ring key 40. Without the spring break mechanism 45, A cannot be played while depressing the thumb ring as, in doing so, the thumb would necessarily close the thumb hole and the G hole which underlies the F-sharp pad cup 74 and muffle the sound of A. By means of the spring break, the F-sharp key 82 is opened by the A-flat key, in turn by the A key, thereby compensating for the thumb hole being closed, allowing the A sound to be as clear and resonant as when fingered with only the A key.

By the previously described B-flat key mechanism, when changing from a note where one of the right-hand rings or ring 38 is depressed to the A note caused by depressing spatula 52, without the desired mechanism, the B-flat note would momentarily open. However, by holding down ring 46, the B-flat opening remains closed and the unwanted intermediate grace note is not created.

F-sharp key 82 has a tube 72 which fits over the shaft of ring key 40. Dog 41 on key forms a limit stop against adjusting screw 71. Spring 43 is anchored in lever 44 and hooked on back end of F-sharp pad cup 74. The depressing of spatulas 76 or 64 opens F-sharp pad cup 74, overcoming the relatively heavy spring 43 between lever 44 and 82 while thumb ring key 46 is depressed. This makes it possible to keep the thumb depressed on ring 46, holding the B-flat key closed, when transitioning from any note involving the "B-flat producing rings" to A and holding the thumb ring key depressed while A is being sounded. However, in the use of the above, the clarinetist must form the habit of sustaining the thumb on its hole and ring while transitioning from notes (except the B-flat itself) involving the depression of the certain rings used in conjunction with the A key to produce the transition from the B-flat to the A note. There is also a relatively light spring anchored to a post hooked to the ring key 40 to restore ring key 40 and F-sharp key 82 to their normal open position.

Figure 2:
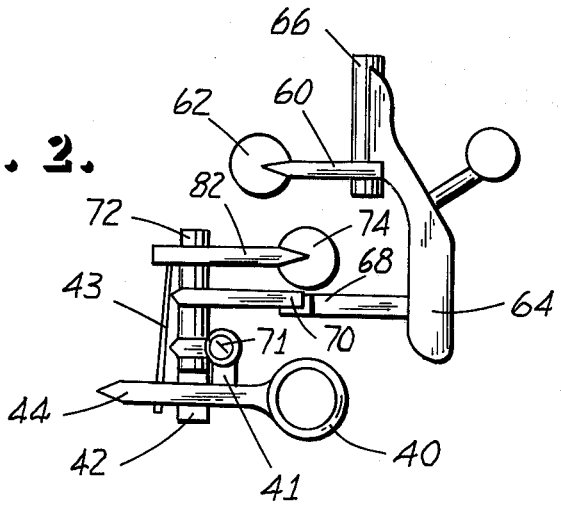
FIG. 2 is a detailed view of a portion of the structure shown in FIG. 1.
Figure 3:
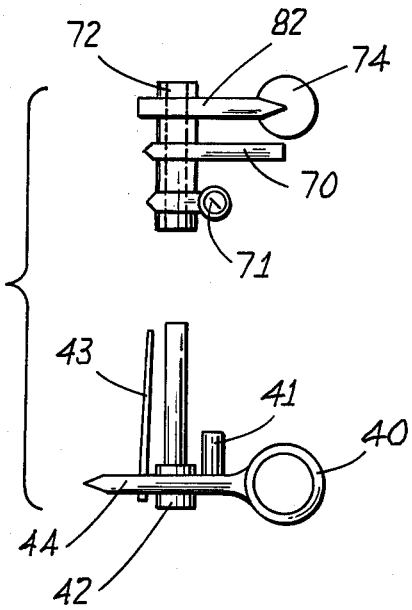
FIG. 3 is an exploded view of a portion of the structure in FIG. 2.

As another aspect of the invention, it is seen in FIGS. 1 and 2 that A-flat key 64 can be depressed to rock around shaft 66 to raise A-flat pad cup 62 to produce the desired note. However, in order to produce an accurately pitched note, a vent needs to be opened to compensate for the closed F-sharp caused by depression of thumb key (since the thumb key is also held down while the F-sharp side key is opened, in conventional fingering of F-sharp in the trill F-sharp to G-sharp (A-flat)). Lever 68 is mounted on A-flat key 64 and engages under lever 70 mounted to rotate on shaft 72. F-sharp pad cup 74 is thus raised off the G opening, even though the thumb key is depressed. Thus, the previously described spring break mechanism in combination with the A-flat connection makes it possible, when the A-flat key is pressed, to provide the necessary venting for the correctly pitched A-flat note. In trilling from F-sharp to A-flat, the F-sharp note is produced, as is conventional in Boehm fingering, with the thumbhole closed and with the F-sharp side trill key open. Under these circumstances, the shift to the A-flat in the trill would ordinarily leave F-sharp pad cup 74 closed, when actually it is required to be open as a vent. The mechanism just described, including levers 68 and 70, opens the G vent when the A-flat key 64 is pressed for trilling, by overcoming the spring 43.

In trilling B-flat over A-flat (using any one or more of the several rings in conjunction with depression of the A key 52 for B-flat), it is necessary to open the A hole under A pad cup 58 when the B-flat opening under B-flat pad cup 32 is open, in order to obtain an accurately pitched B-flat. A-flat pad cup 62 is maintained open conveniently and with increased leverage by the use of an auxiliary spatula 76 secured to A-flat key 64. It is positioned so that the pad at the third finger joint of the left first finger can be employed to maintain the key opening. The A opening under A pad cup 58 is operated by rocker arm lever 78 which engages under the outer end of A lever 54 and is pivotable on a finger which extends from the central part of 78 and is poised at its own extremity over lever 82 of pad cup 74. The lower end of lever 78 is pivoted to shaft 80 which is mounted upon the side of pivot shaft 20. Thus, by operation of any of the lower rings, the lower end of lever 78 is moved toward the clarinet body. If the center of lever 82 is raised by operation of the A-flat key 64, as previously described, then this serves as a pivot point for rocker arm lever 78 so that the upper end of lever 78 engaged under key 54 causes lifting of the A pad cup 58 off of the A opening. In this way, whenever the A-flat key 64 is pressed down, the simultaneous opening of the B-flat hole by use of the rings will cause opening of the A hole as a vent therefor. By this means, an accurate trill between B-flat and A-flat is accomplished. Because of this, the former "B-flat side trill key" as used on the conventional clarinets can be dispensed with. The position formerly occupied by that key may be utilized for a B key lever in the same manner as that of FIG. 1 of Mazzeo U.S. Pat. No. 3,035,473.

In trilling A flat to A engagement of the third finger joint over auxiliary spatula 76 permits maintaining the A-flat hole open, while reaching over with the tip of the first finger of the left hand to engage spatula 52 to trill the A note by repeated operation of that key.

As seen in FIG. 1, register key 84 is fixed on a central shaft so that, when it is depressed, it raises register pad cup 86 for the conventional register change. B key 88 spatula is connected through an adjustment mechanism 90 so that, when it is depressed, it raises the B pad cup 92. When B pad cup 92 is raised, the upper end of B-flat key 34 is raised to open the B-flat opening to provide vent for the B note and for accurate trilling of A to B-flat, using the B side lever. The two spatulas 84 and 88 are provided side-by-side because, when they are both pressed, a C note is produced. Thus, merely by depressing keys 84 and 88, an accurate C note is achieved. A one-way connection may be incorporated between the two spatulas to insure both the B and register holes opening simultaneously for a crisp beginning of the C note. In this case, the spatula 88 would be used only for a C and could not be used for B. The B side lever would be used always, when trilling A to B or B-flat to B. The inter-relationship between the register opening and the B-flat opening to achieve the accurate C note may be present only in the soprano B-flat clarinet and thus this arrangement may be applicable only to that instrument. The clarinet in question is intended to be equipped with the side key lever conventionally used for B-flat, but on this clarinet is used for the B note. This lever engages under lever 94 so that, when the side key B is pressed, lever 94 rises to raise B pad cup 92 off of the B opening for trilling B-flat or A. When trilling A, the B pad cup 92 raises B-flat pad cup 32 by means of an adjustment screw on B-flat key 34, thereby insuring an accurately pitched B note.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. On a clarinet, a spring-break clarinet key mechanism comprising:

a first pad for covering a first tonal opening in a clarinet body, said first pad being mounted on a first arm and said first arm being pivotable about a first axis for moving said first pad into and out of closed position with respect to said first tonal opening, a ring key pivotally mounted on said first axis, said first arm and said first axis being free to rotate relative to each other, a spring having one end connected to said ring key and the other end bearing against said first arm to urge said first pad into closed position when said ring key is depressed;

a second pad for moving out of and into closed position over a second tonal opening in the clarinet body, and interengaging means between said second pad and said first pad so that, when said second pad is in the open position, said first pad is urged into the open position against the tension of said spring if said ring key is depressed.

2. The spring-break mechanism of claim 1 wherein said first pad is over a G opening and said second pad is over an A-flat opening.

3. The spring-break mechanism of claim 1 wherein said second pad is an A-flat pad positioned over an A-flat tonal opening in the clarinet body and further including an A-flat spatula connected to raise said A-flat pad off of its opening upon depressing of said A-flat spatula, an A-flat lever connected to said A-flat spatula and a second arm connected to said first arm and interengaged with said A-flat lever so that, upon depression of said A-flat spatula and raising of said A-flat pad off of its tonal opening, said first pad is also raised off its tonal opening.

4. The spring-break mechanism of claim 3 further including a stop between said ring key and said first arm to limit rotation of said ring key about said first axis with respect to said first arm in a direction opposite to the urging of said spring.

5. The spring-break mechanism of claim 4 further including a B-flat tonal opening and a B-flat pad cup mounted on a B-flat pivoted lever so that said B-flat pad cup can be moved into and away from a position where it closes the B-flat tonal opening, inter-engaging means between said ring key and said B-flat lever so that, when said ring key is depressed, said B-flat key is held closed.

6. The spring-break mechanism of claim 5 further including a second spatula on said A-flat key for engagement by the third finger joint of the first finger to permit the finger tip to reach the A key for A over A-flat trill.

7. The spring-break mechanism of claim 6 further including a register key connected to open a register tonal hole and a B key connected to open a B tonal hole and connected to open a B-flat tonal hole, said register key and said B key spatulas being positioned to be simultaneously operable by a single finger to achieve a C note.

* * * * *